US005786797A

United States Patent [19]

Kapoor et al.

[11] Patent Number: 5,786,797

[45] Date of Patent: Jul. 28, 1998

[54] INCREASED BRIGHTNESS DRIVE SYSTEM FOR AN ELECTROLUMINESCENT DISPLAY PANEL

[75] Inventors: Mohan Lal Kapoor, Orange; Dominic Louis Monarchie, Norwalk; Thomas John Rebeschi, North Haven; Russell Anthony Budzilek, Bridgeport, all of Conn.

[73] Assignee: Northrop Grumman Corporation, Los Angeles, Calif.

[21] Appl. No.: 705,977

[22] Filed: Aug. 30, 1996

Related U.S. Application Data

[63] Continuation of Ser. No. 367,901, Jan. 3, 1995, abandoned, which is a continuation of Ser. No. 210,118, Mar. 17, 1994, abandoned, which is a continuation of Ser. No. 988,545, Dec. 10, 1992, abandoned.

[51] Int. Cl.[6] ..... G09G 3/30

[52] U.S. Cl. ..... 345/79; 345/209; 315/169.3

[58] Field of Search ..... 345/58, 76, 78, 345/77, 79, 80, 208, 209, 36; 315/169.3; 340/825.81

[56] References Cited

U.S. PATENT DOCUMENTS

| | | | |
|---|---|---|---|
| 3,975,661 | 8/1976 | Kanatani et al. | 315/169 |
| 4,152,626 | 5/1979 | Hatta et al. | 340/781 |
| 4,479,120 | 10/1984 | Ohba et al. | 340/781 |
| 4,485,379 | 11/1984 | Kinoshita et al. | 340/781 |
| 4,488,150 | 12/1984 | Kanatani | 345/77 |
| 4,691,144 | 9/1987 | King et al. | 340/781 |
| 4,733,228 | 3/1988 | Flegal | 345/76 |
| 4,739,320 | 4/1988 | Rolinar et al. | 345/78 |
| 4,801,920 | 1/1989 | Ohba et al. | 340/781 |
| 4,866,348 | 9/1989 | Harada et al. | 345/79 |
| 4,888,523 | 12/1989 | Shoji et al. | 345/79 |
| 4,893,060 | 1/1990 | Ohba et al. | 345/209 |
| 4,951,041 | 8/1990 | Inada et al. | 345/147 |
| 4,975,691 | 12/1990 | Lee | 345/209 |
| 5,075,596 | 12/1991 | Young et al. | 340/781 |
| 5,294,919 | 3/1994 | Harju | 345/208 |
| 5,408,252 | 4/1995 | Oki et al. | 345/98 |
| 5,550,557 | 8/1996 | Kapoor et al. | 345/96 |

FOREIGN PATENT DOCUMENTS

| | | |
|---|---|---|
| 0249954 | 12/1987 | European Pat. Off. . |
| 0295477 | 12/1988 | European Pat. Off. . |
| 0345399 | 12/1989 | European Pat. Off. . |
| 2086634 | 5/1982 | United Kingdom . |

OTHER PUBLICATIONS

<<Rata Book 1988–1989>> by Superten Inc. pp. 11–4–11–8.

*Primary Examiner*—Richard Hjerpe
*Assistant Examiner*—Lun-Yi Lao
*Attorney, Agent, or Firm*—Walter G. Sutcliff

[57] ABSTRACT

A thin film electroluminescent display panel is driven with either a symmetric or asymmetric drive scheme which includes at least one equalizing voltage pulse per write cycle to remove carriers trapped at the interfaces of dielectric layers and phosphor layer in order to stabilize the charge of each display panel pixel. The present invention reduces the smearing, latent image and pseudo persistence problems caused by carriers being retained and accumulated at the dielectric and phosphor layer interfaces.

5 Claims, 10 Drawing Sheets

INCREASED BRIGHTNESS DRIVE SYSTEM FOR AN ELECTROLUMINESCENT DISPLAY PANEL

This application is a continuation of application Ser. No. 08/367,901 filed on Jan. 3, 1995, now abandoned, which is a Rule 62 Continuation Application of Ser. No. 08/210,118, filed Mar. 17, 1994, now abandoned, which is a Rule 62 Continuation Application of Ser. No. 07/988,545, filed Dec. 10, 1992, now abandoned.

CROSS REFERENCE TO RELATED APPLICATIONS

This application contains subject matter related to commonly assigned application filed Jun. 30, 1992, designated Ser. No. 07/906,605, and entitled "Symmetric Drive For An Electroluminescent Display Panel", now abandoned.

1. Technical Field

This invention relates to electroluminescent displays, and more particularly to how an electroluminescent display panel is electronically driven.

2. Background Art

The operation of an AC thin film electroluminescent (TFEL) display panel is based on the principle that a luminescent material (e.g., phosphor) will emit light when a voltage of sufficient magnitude is applied across it. The TFEL display is typically constructed with luminescent material sandwiched between a dielectric insulator and a plurality of row electrodes on one side, and a plurality of column electrodes on the opposite side. Each intersection of the plurality of row and column electrodes defines a pixel. A typical high resolution TFEL display panel may have 512 row electrodes and 640 column electrodes, resulting in 327,680 pixels.

The luminance of each pixel in the panel is dependent upon the magnitude of the voltage applied across the particular row and column electrode which define the pixel. A problem with a TFEL display panel is that it often suffers from latent imaging and pseudo persistence problems which cause smearing and ghost images on the display panel. This is a result of the pixel's voltage-time average being non-zero when averaged over several scans through the panel. One approach to reduce these problems is utilizing a symmetric drive system for the panel. However, this approach has the undesirable effect of reducing pixel brightness by up to 50% since the second light pulse which occurs with the application of the refresh pulse is eliminated in symmetric drive systems. Such a reduction in brightness is unacceptable when sunlight viewability is required.

SUMMARY OF THE INVENTION

An object of the present invention is to provide a thin film electroluminescent display panel with reduced latent image and pseudo persistence problems.

Another object of the present invention is to increase display panel brightness while reducing the undesirable latent image and pseudo persistence effects.

According to the present invention, a thin film electroluminescent display panel is driven with either a symmetric or asymmetric drive scheme which includes at least one equalizing voltage pulse per write cycle to remove trapped carriers at the interfaces between the insulating dielectric layers and the phosphor layer of the display panel to stabilize the charge of each display panel pixel.

The present invention reduces the smearing, latent image and pseudo persistence problems caused by carriers being retained and accumulated at the interface between the insulating dielectric layer and the phosphor layer of the panel.

These and other objects, features and advantages of the present invention will become more apparent in light of the following detailed description of a preferred embodiment thereof, as illustrated in the drawings.

BEST MODE FOR CARRYING OUT THE INVENTION

Figure 1:
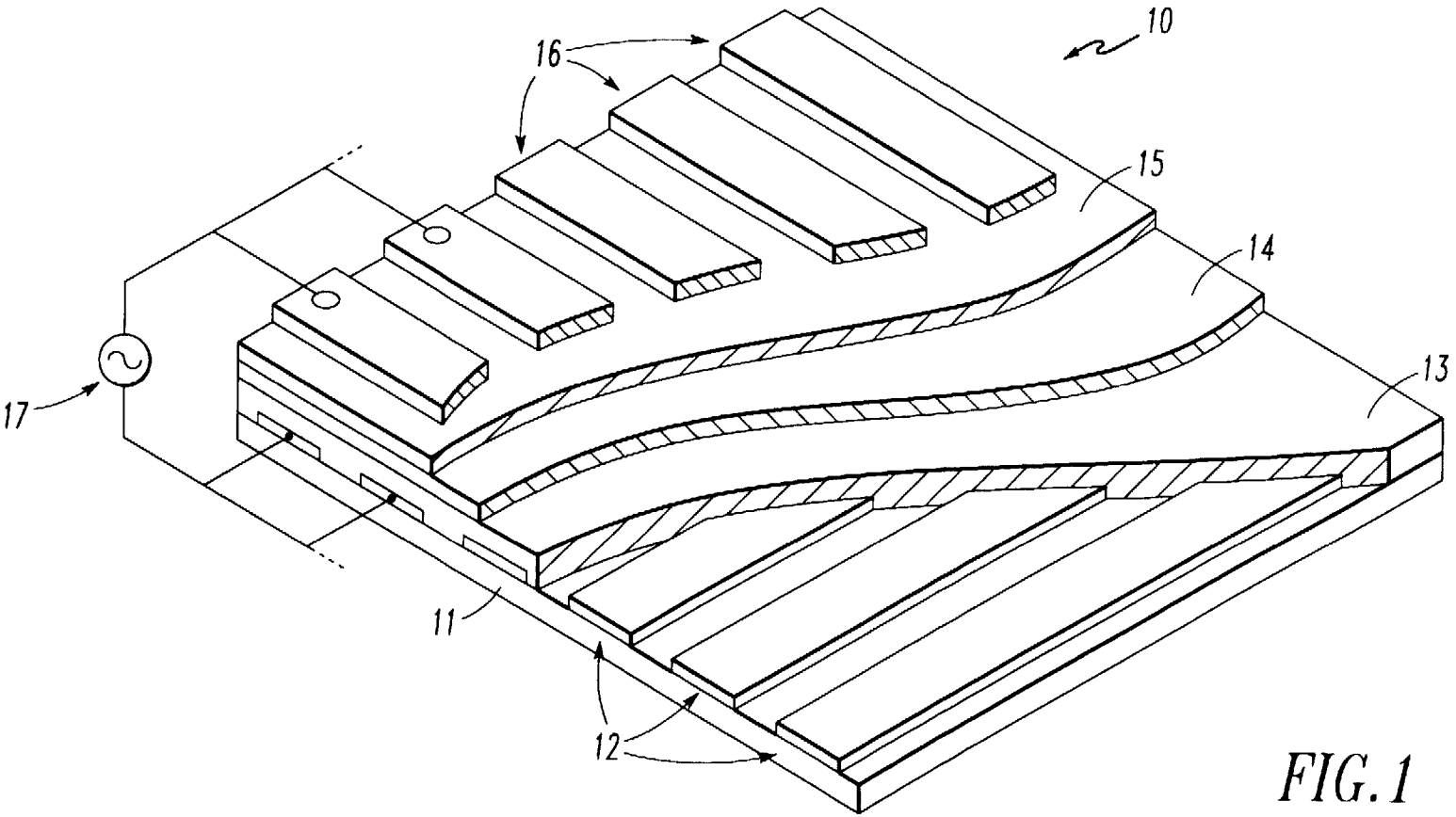
FIG. 1 is a partial sectional view of an AC thin film electroluminescent (TFEL) display panel.

Referring to FIG. 1, a thin film electroluminescent (TFEL) display panel 10 includes a glass substrate 11, a plurality of transparent electrodes 12, a first layer of insulating material 13, a layer of electroluminescent material 14, a second layer of insulating material 15 and a plurality of rear electrodes 16. The glass substrate 11 is preferably a borosilicate glass such as CORNING 7059available from Corning Glassworks of Corning, N.Y. Each of the plurality of transparent electrodes 12 is preferably indium-tin oxide (ITO) and each of the plurality of rear electrodes is aluminum (Al). The insulating layers 13,15 include a dielectric material and each layer acts as a capacitor to protect the electroluminescent material 14 from high direct electrical dc currents. The electroluminescent material is typically ZnS doped with Mn.

When a voltage source 17 applies a voltage signal across the electrodes 12,16 respectively, electrons flow and tunnel through the layers 13–15 between the electrodes 12,16. These electrons excite the Mn in the electroluminescent material, such that, the Mn emits photons which pass through both the first insulating layer 13 and the transparent electrodes 12 to form an image on the glass 11 when the magnitude of the voltage signal across the electrodes is above a threshold voltage (e.g., 160 volts).

The latent image and pseudo persistence problems discussed hereinbefore are a result of electrical charge being accumulated at an interface of one of the insulating layers 13,15, and not being cancelled when the polarity of the voltage source 17 is reversed. Constant switching of the voltage polarity can lead to an accumulation of charge at the interfaces between the insulating layers and phosphor layer at specific pixel sites and hence the latent image and pseudo persistence problems.

Figure 2:
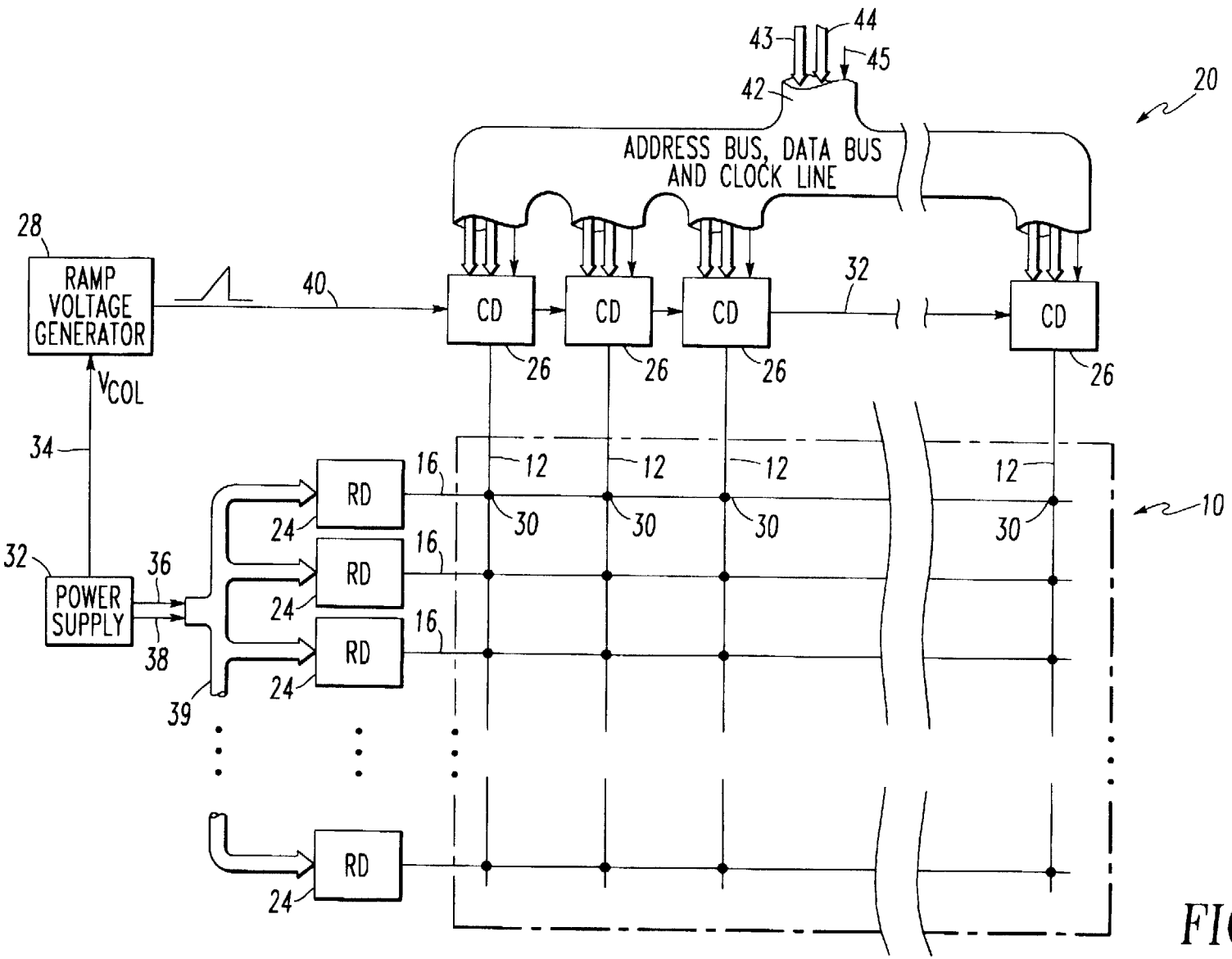
FIG. 2 is a block diagram of the TFEL display panel of FIG. 1 and the panel's associated electronic drive circuitry.

FIG. 2 is a block diagram illustration of a TFEL display panel system 20 which includes the TFEL display panel 10 and electronic circuitry to drive the panel. The system 20 includes a plurality of row drivers 24, a plurality of column drivers 26, and a ramp voltage generator 28. A power supply 32 provides a constant value maximum column driver voltage signal $V_{col}$ on a line 34 to the ramp voltage generator 28. The power supply also provides two voltage signal values $V_{pos}$ and $V_{neg}$ on lines 36 and 38 respectively to each of the plurality of row drivers 24 via a bus 39.

The display panel 10 is driven in a well known manner utilizing a row-at-a-time drive scheme where a voltage equal to the threshold voltage $V_{th}$ is placed on one of the aluminum row electrodes 16. This allows the luminance of the individual pixels in the row to be independently controlled by regulating the magnitude of the voltage the column driver 26 places on each of the plurality of transparent electrodes 12. If the panel employs a symmetric drive scheme, the next scan through the panel a voltage of equal magnitude but opposite polarity is applied to each pixel in the row. Whereas if the panel employs an asymmetric drive scheme, when all the rows have been written to (i.e., a write cycle has been completed) a refresh pulse is applied to all the rows simultaneously. A detailed example of how the panel is symmetrically and asymmetrically driven according to the present invention will be presented hereinafter.

To control the column driver voltage, the ramp voltage generator 28 provides a ramped voltage signal (continuous or discrete) on a line 40 to each of the plurality of column drivers 26. The signal on the line 40 typically ramps over a fixed duration from zero vdc to a voltage equal to the maximum column driver voltage signal value $V_{col}$ (e.g., +60 vdc) on the line 34. Each of the column drivers operates as a sample-and-hold device and receives the ramped voltage signal on the line 40, samples it at a predetermined time and retains (i.e., holds) the sampled voltage signal value. The column drivers interface with a controller (not shown) via a bus 42 which contains address, data, and clock lines 43–45 respectfully. Each column driver can sample the ramped voltage signal on the line 40 at a different time, and the instant each column driver samples the signal is controlled by the value each receives over the data lines 40. This allows the luminance of each individual pixel 30 to be independently controlled (gray-scaling) by regulating the magnitude of the voltage placed on each of the plurality of transparent column electrodes 12. The procedure is repeated for each row of pixels, and in general is repeated indefinitely while the panel is powered and displaying information.

Figure 3A:
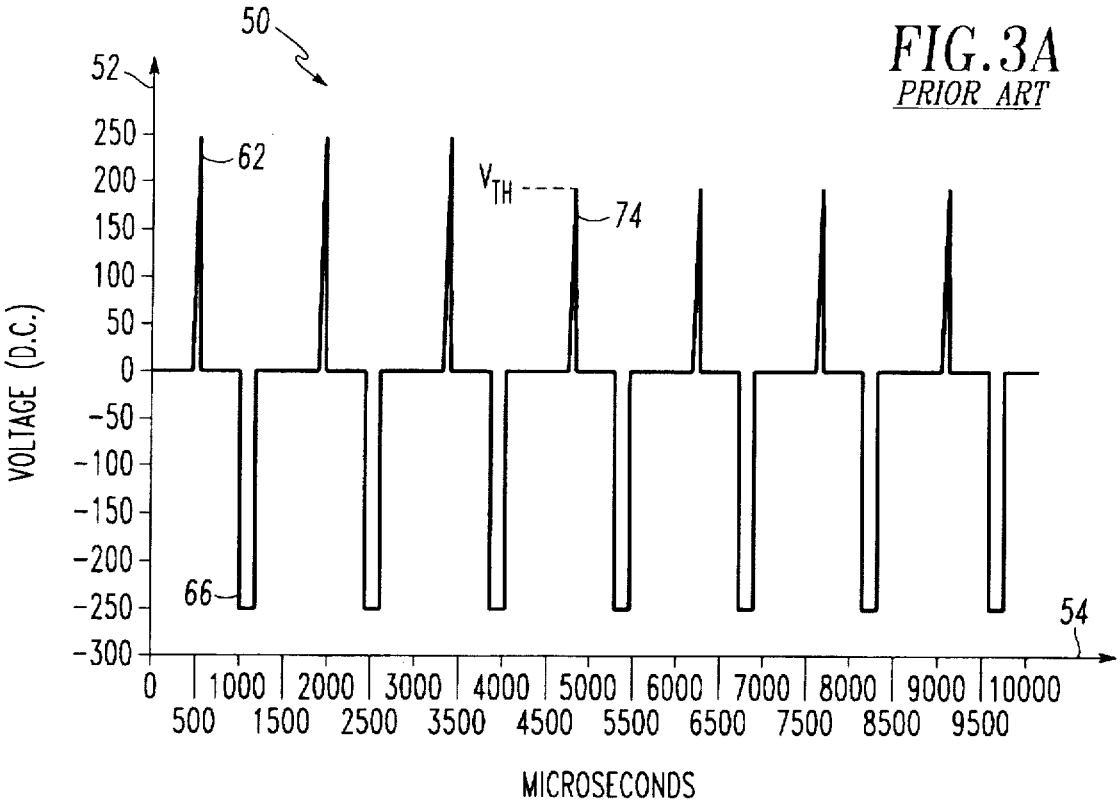
FIG.3A PRIOR ART
FIGS. 3A and 3B are actual plots of test results illustrating a prior art asymmetric drive scheme and the light output which resulted from applying the pulse train of the prior art drive scheme.
Figure 3B:
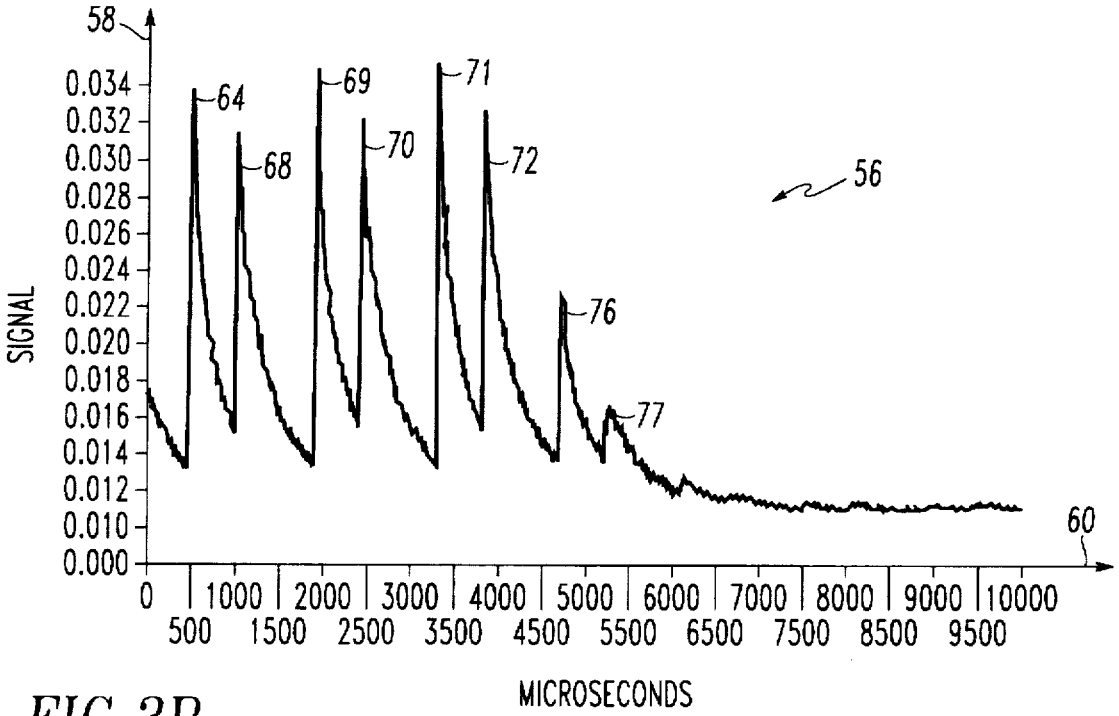
FIG.3B PRIOR ART

The problem of smearing and ghost images on the panel is best understood by reviewing several plots illustrating the unwanted light output that results due to the retained charge. FIG. 3A is a plot 50 illustrating a sequence of actual asymmetric drive pulses written to the display panel 10. The voltage magnitude is plotted along a vertical axis 52 and time is plotted along a horizontal axis 54. FIG. 3B is a plot 56 illustrating light output as a result of driving the display panel 10 with the sequence of drive pulses illustrated in FIG. 3A. The magnitude of light output is plotted along a vertical axis 58 and time is plotted along a horizontal axis 60. Referring now to both FIGS. 3A and 3B, a first write pulse 62 is written at time approximately equal to 500 microseconds resulting in a pulse of light 64. Approximately 500 microseconds later the display panel is hit with a refresh pulse 66 which results in a second pulse of light 68. This pattern of write and refresh pulses is repeated several times resulting in light pulse outputs 69–72. At approximately 4700 microseconds, the magnitude of the write pulse 74 is set equal to the threshold voltage value, which ideally should result in no light output since light is only emitted when the voltage across a pixel is above the threshold voltage value. However, even though the voltage magnitude of the write pulses is not above the threshold voltage value, several unwanted light pulses 76,77 still result due to the retained electrical charge at the interfaces between insulating dielectric layers (13,15) and the phosphor layer 14. These unwanted light pulses 76,77 manifest themselves as the smearing and ghost image problems discussed hereinbefore.

Figure 4A:
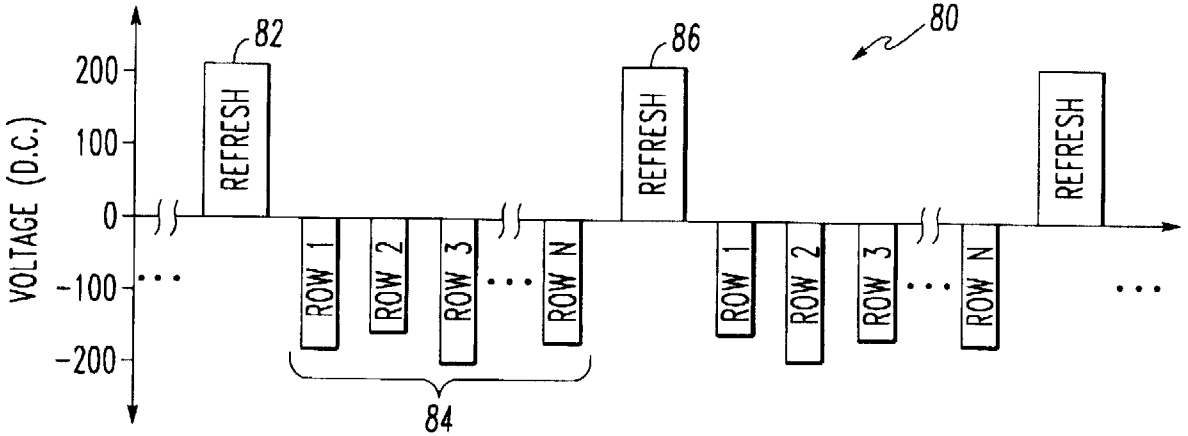
FIG. 4A PRIOR ART
FIGS. 4A and 4B are plots of waveforms illustrating a prior art asymmetric drive scheme and a prior art symmetric drive scheme.
Figure 4B:
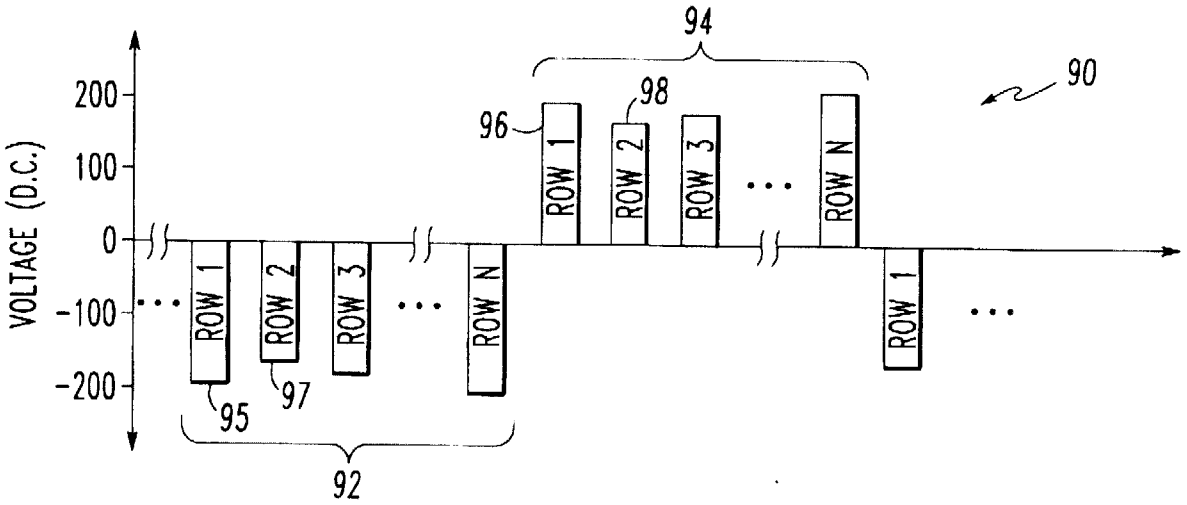
FIG. 4B PRIOR ART

FIG. 4A is a plot 80 illustrating a more detailed prior art asymmetric drive scheme. The sequence of pulses in the drive scheme includes a refresh pulse 82 followed by a plurality of write pulses 84 indicative of one write pulse per row in the display panel 10. When the write cycle is completed, that is, when all the rows in the display panel have been written to, a second refresh pulse 86 is written to all the rows simultaneously. Note, the magnitude of the write pulses 84 are illustrated as varying to represent the gray scale capability of the display panel 10. Having observed the details of the asymmetric drive scheme in FIG. 4A, we can now turn to FIG. 4B which is a plot 90 illustrating a prior art symmetric drive scheme.

The sequence of pulses in the symmetric drive scheme includes a plurality of negative voltage pulses 92 followed by a plurality of voltage pulses 94 which are equal in magnitude, but opposite in polarity to their corresponding negative voltage pulses 92. As an example, pulse 95 is equal in magnitude but opposite in polarity to pulse 96. Similarly, pulse 97 has the same magnitude as pulse 98 but opposite polarity.

Figure 5A:
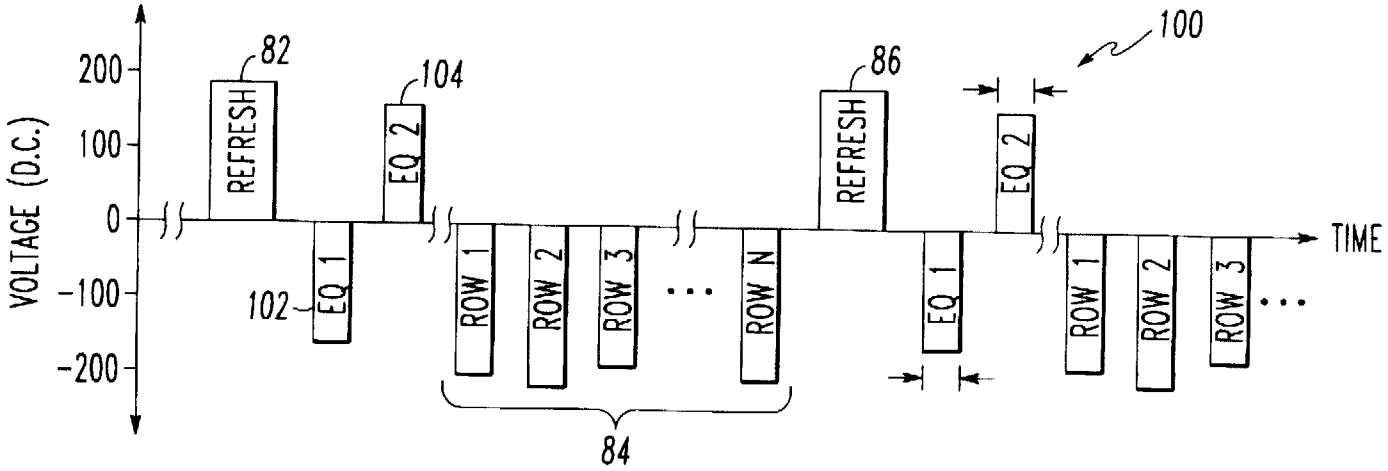
FIGS. 5A and 5B are plots of waveforms of an asymmetric drive scheme and a symmetric drive scheme both incorporating at least one equalizing pulse according to the present invention.
Figure 5B:
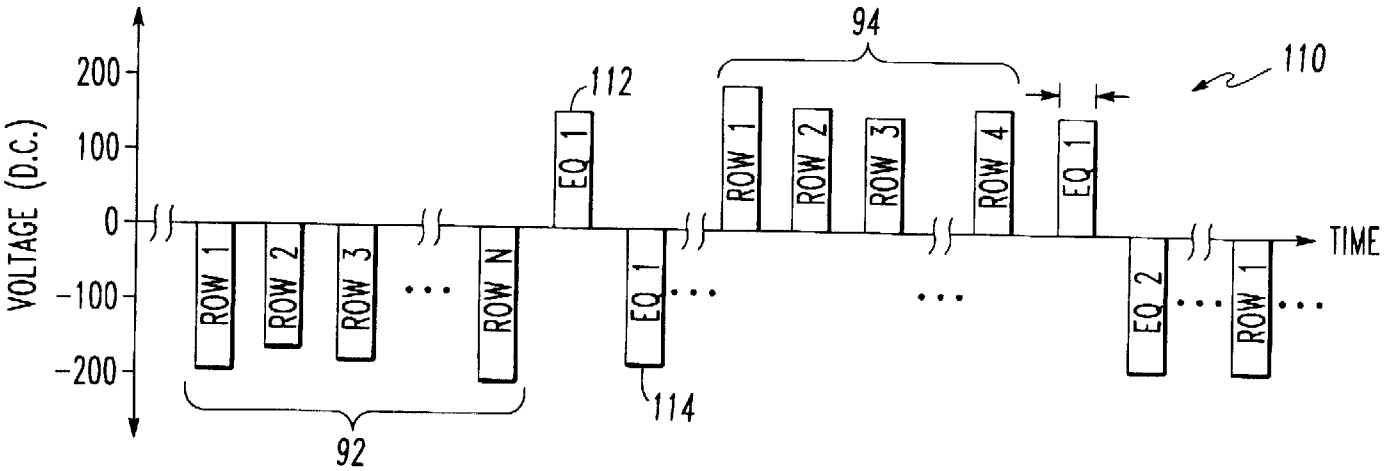

FIGS. 5A & 5B each illustrate a sequence of voltage pulses which are applied to the display panel 10 according to the present invention. Referring to FIG. 5A, plot 100 illustrates an improved asymmetric drive sequence which includes the conventional refresh and write pulses 82,84 respectively, along with several equalizing pulses 102,104. The equalizing pulses 102,104 remove electrons trapped at the interfaces of the insulating dielectric layers 13,15 to help stabilize pixel charge after a write cycle through the display panel. The net result is a reduction in the DC voltage offset across each pixel. Similar to the refresh pulse 82,86, the equalizing pulses are applied to each pixel in the display panel simultaneously.

The pulse width of each equalizing pulse 102, 104 is greater than or equal to the pulse width of the write pulse 84. Preferably, the pulse width of each equalizing pulse 102, 104 is about e to the pulse width of the write pulse 84 (e.g. 30 microseconds). In general the pulse width should be five times the panel RC time constant. The magnitude of each equalizing pulse 102, 104 and the number of equalizing pulses are empirically determined to arrive at a desired sequence of voltage pulses which decreases the light pulse decay time, to reduce the latent image and pseudo persistence problems.

The equalizing pulses of the present invention may also be utilized in a symmetric drive sequence. Referring to FIG. 5B, a sequence of pulses 110 includes the plurality of negative write pulses 92, and the plurality of positive write pulses 94 similar in character to the pulses in FIG. 4B, and at least one equalizing pulse, such as two equalizing pulses 112,114. Similar in character to pulses 102,104, equalizing pulses 112,114 include a variable voltage amplitude which is empirically adjusted until the panel response (discussed hereinbefore with respect to FIG. 3) approaches the ideal. The effectiveness of thee equalizing pulses is best shown with actual test results.

Figure 6A:
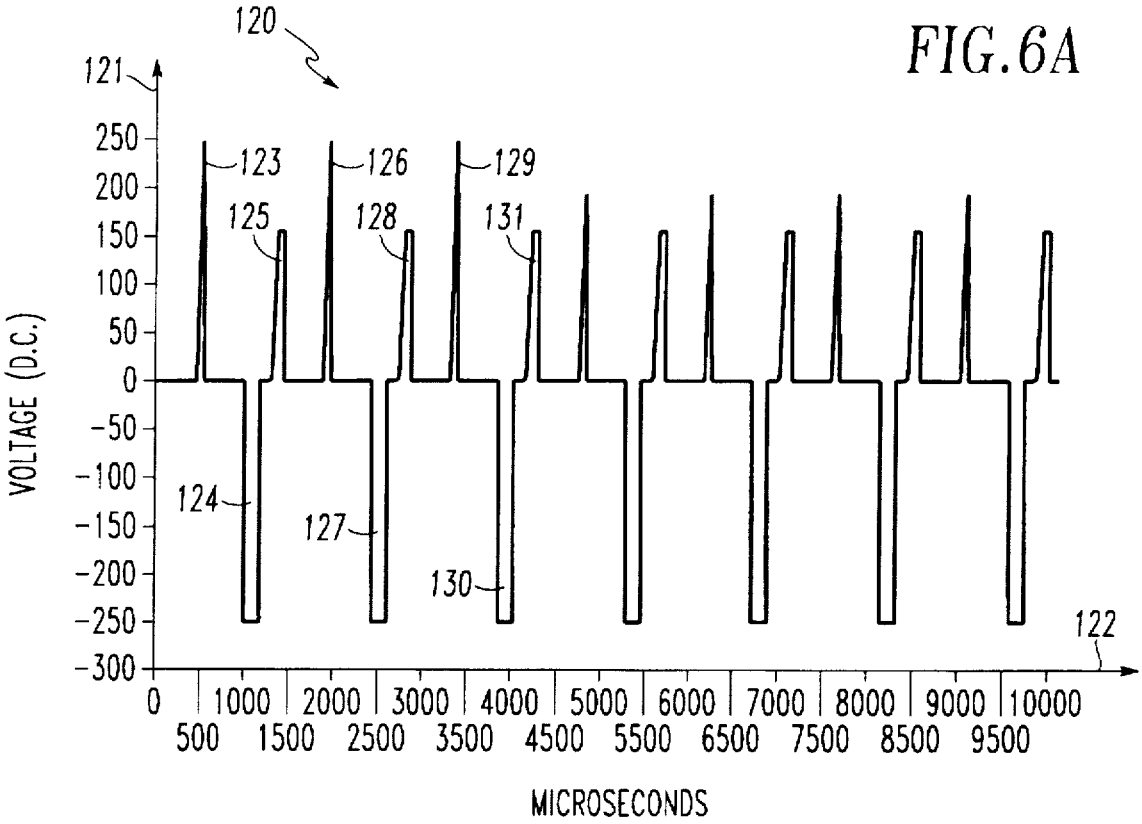
FIGS. 6A and 6B are actual plots of test results illustrating an asymmetric drive scheme incorporating an equalizing pulse according to the present invention, and the light output which resulted from applying this drive scheme to a TFEL display panel.
Figure 6B:
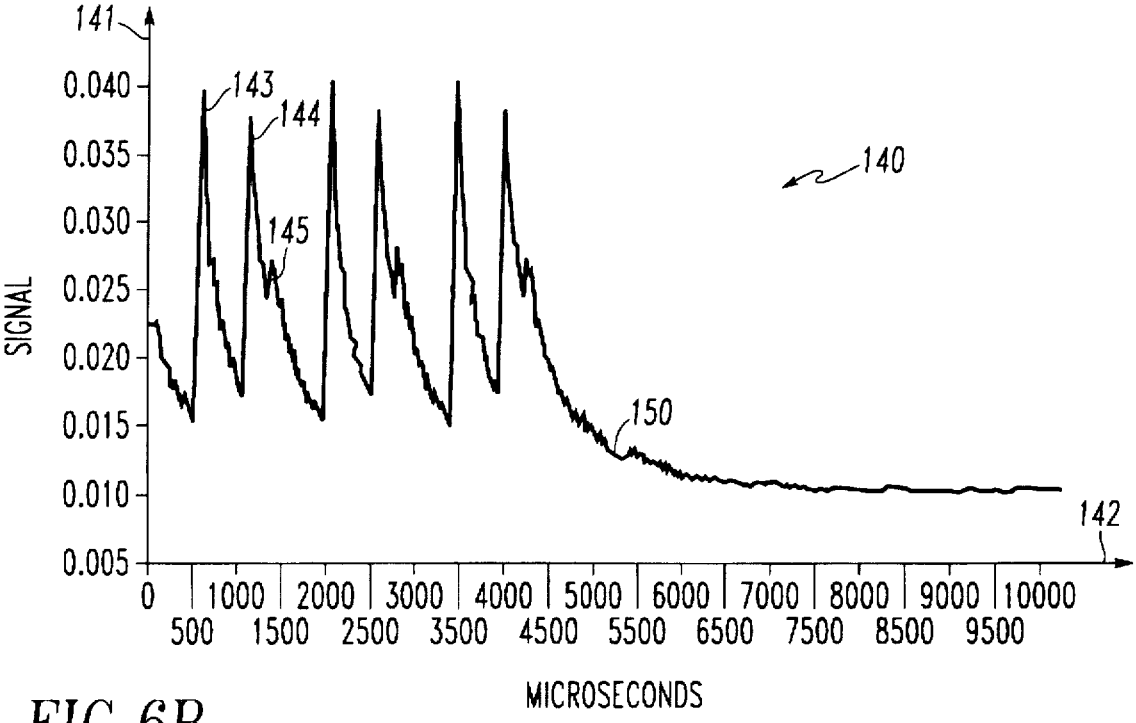

FIG. 6A is a plot 120 of test results from an asymmetric drive sequence according to the present invention. Voltage is plotted along a vertical axis 121 and time is plotted along a horizontal axis 122. FIG. 6B is a plot 140 of light output as a result of applying the drive sequence of FIG. 6A to the display panel 10. Light output is plotted along a vertical axis 141 and time is plotted along a horizontal axis 142. Referring to both FIGS. 6A and 6B, at time approximately equal to 500 microseconds a first write pulse 123 is applied to the display panel resulting in a light pulse 143. Approximately 500 microseconds later a refresh pulse 124 is simultaneously applied to all the rows in the display panel resulting in a pulse 144 of light output. Immediately following the refresh pulse 124 an equalizing pulse 125 is applied resulting in light pulse 145. A series of write, refresh, and equalizing pulses 126–131 are applied resulting in light pulses 146–151 respectively. At time equal to approximately 4700 microseconds a write pulse 154 equal to the threshold voltage value $V_{th}$ is applied to the panel which ideally should result in no light pulse since the voltage applied across the panel is not above the threshold voltage value. As desired, the light output decays along a line 150. The effectiveness of the present invention in reducing pseudo persistence and smearing while increasing display brightness can also be illustrated by comparing FIGS. 3A and 3B with FIGS. 6A and 6B respectively.

Referring now to FIGS. 3B and 6B, an increase in overall display panel brightness can be seen in the magnitude of the light pulses in FIG. 6B in comparison to FIG. 3B. As an example, the magnitude of pulse 143 (FIG. 6B) is about 0.40 (unitless) while the magnitude of light pulse 64 is about 0.34 (unitless). Similarly light pulse 144 (FIG. 6B) has a magnitude of about 0.37 while light pulse 68 (FIG. 3B) has a magnitude of about 0.32. This represents an overall increase in display panel brightness.

FIGS. 3 and 6 also illustrate the reduction of pseudo persistence and latent image problems. Referring to FIGS. 3A,3B,6A and 6B, starting at time approximately equal to 4700 microseconds the magnitude of the write pulse 74 voltage value drops to a value equal to the threshold voltage value. However, the prior art result as illustrated in FIG. 3B still provides unwanted light pulse outputs 76,77. In sharp comparison, the drive scheme of the present invention 120 (FIG. 6A) provides a smooth, decaying, display panel light output along the line 150. Note the light output along the line 150 is void of the unwanted light pulses 76,77 of the prior art, thus illustrating the improvement over the pseudo persistence and latent image problems of the prior art discussed hereinbefore.

Note that while two equalizing pulses 112, 114 are illustrated in FIGS. 5A and 5B, the invention is clearly not so limited. In fact, it is contemplated there are many different sequences of equalizing and write pulses that can be combined according to the present invention. As an example, rather than placing the equalizing pulses at the end of the write cycle, the equalizing pulses may be interspersed within the sequence of write pulses.

Figure 7:
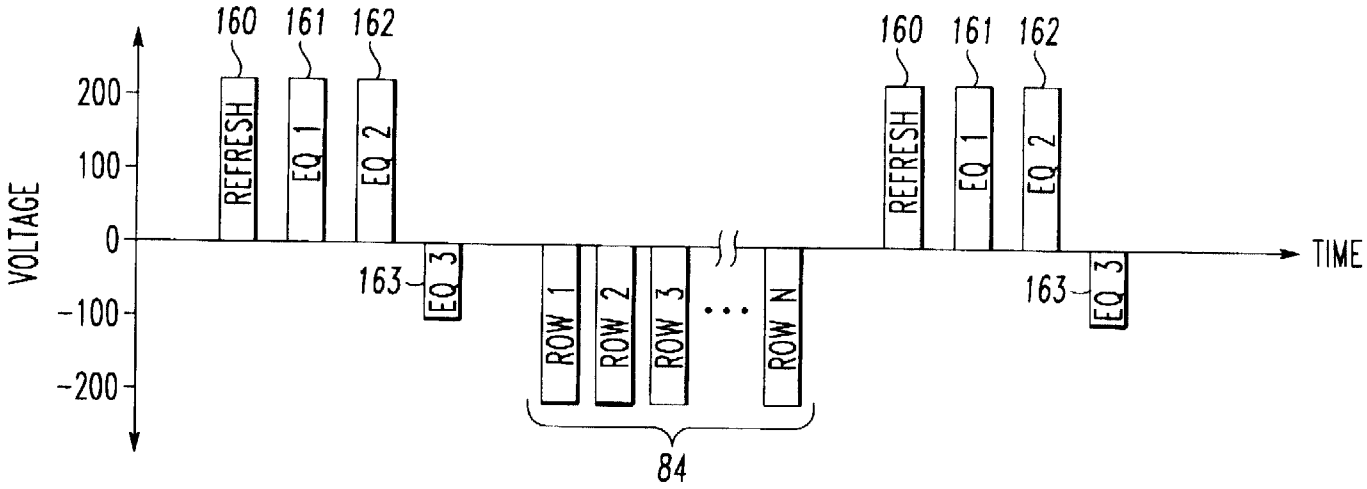
FIGS. 7–14 each illustrate alternative asymmetric drive sequences.
Figure 8:
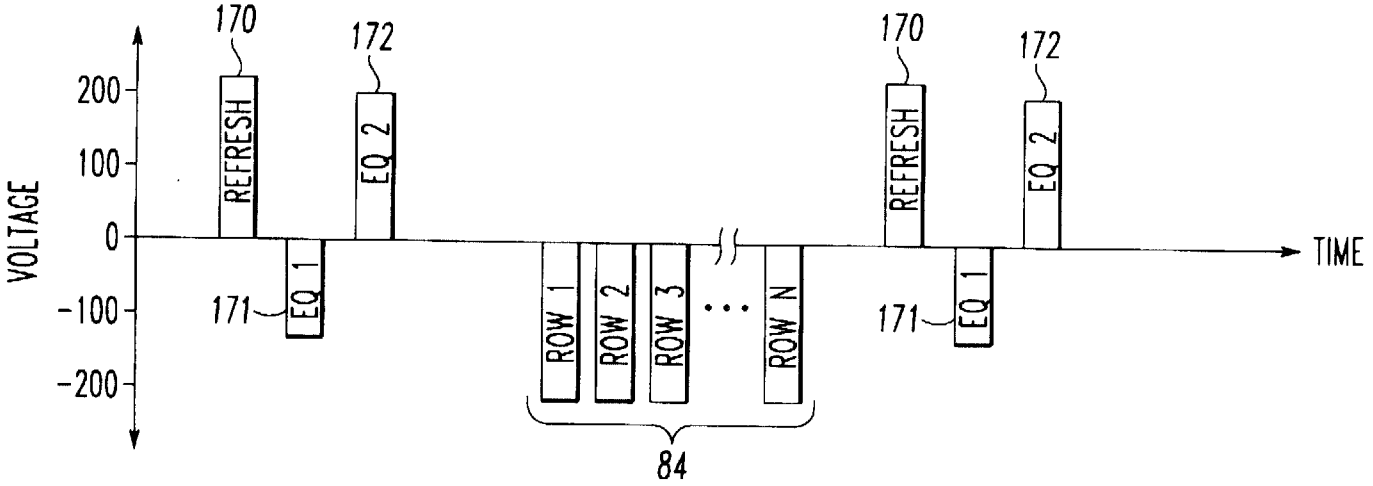

FIGS. 7–14 each illustrate an alternative sequence of voltage pulses which were applied to the display panel 10 according to the present invention. Referring to FIG. 7, a refresh pulse 160 of 220 vdc is applied, followed by three equalizing pulses 161–163: two 220 VDC pulses and a −100 VDC pulse. The plurality of write pulses 84 are then applied, and the pattern is repeated starting with the refresh pulse 160. FIG. 8 illustrates a sequence which first applies a refresh pulse 170 of 220 VDC followed by two equalizing pulses: a −120 VDC pulse 171 and a 200 VDC pulse 172. FIGS. 9–14 are self-explanatory.

Figure 9:
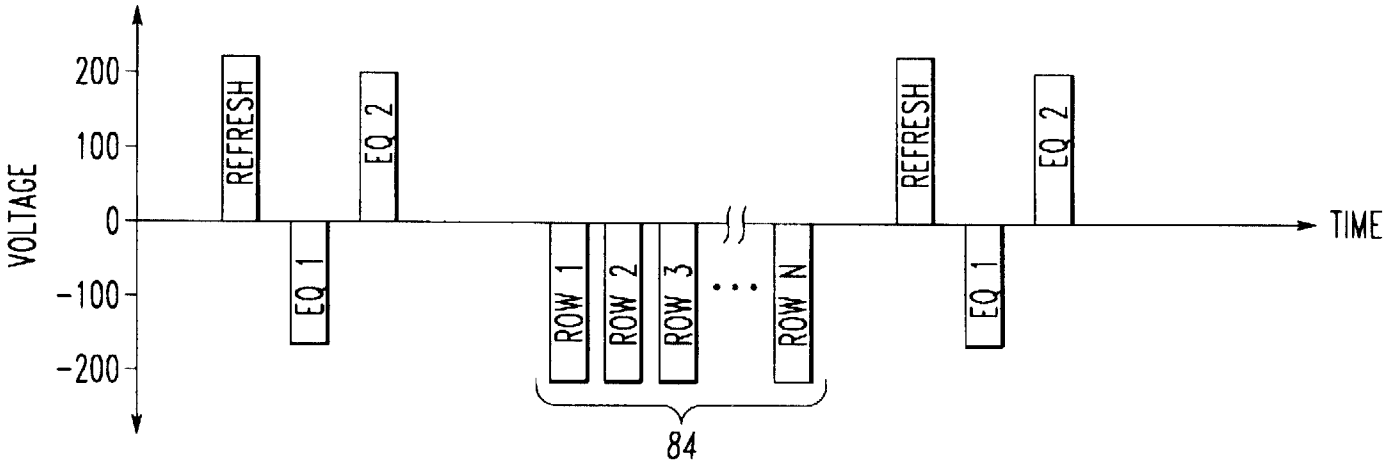
Figure 10:
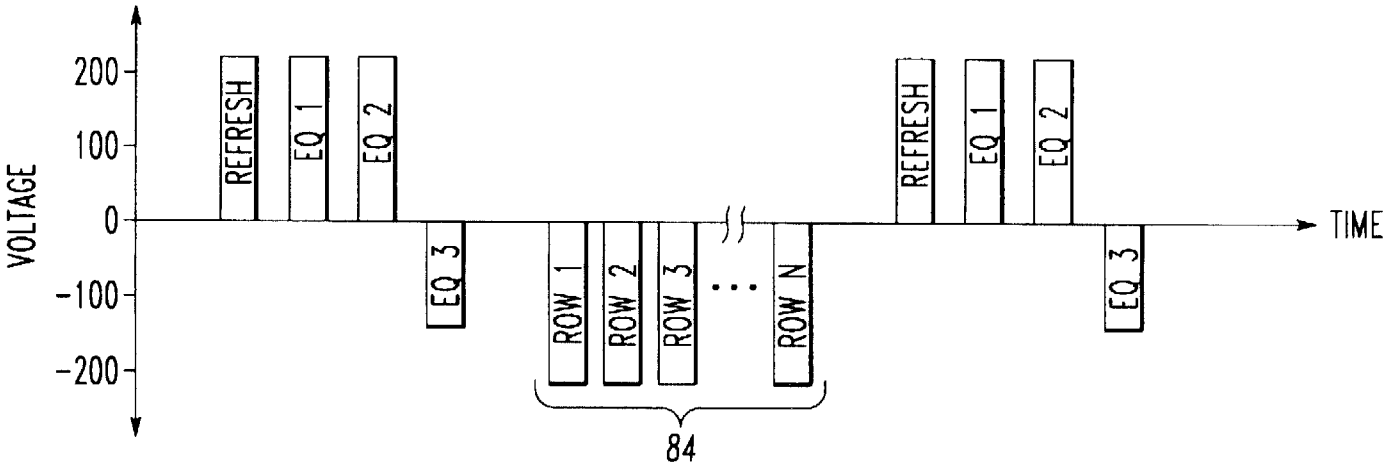
Figure 11:
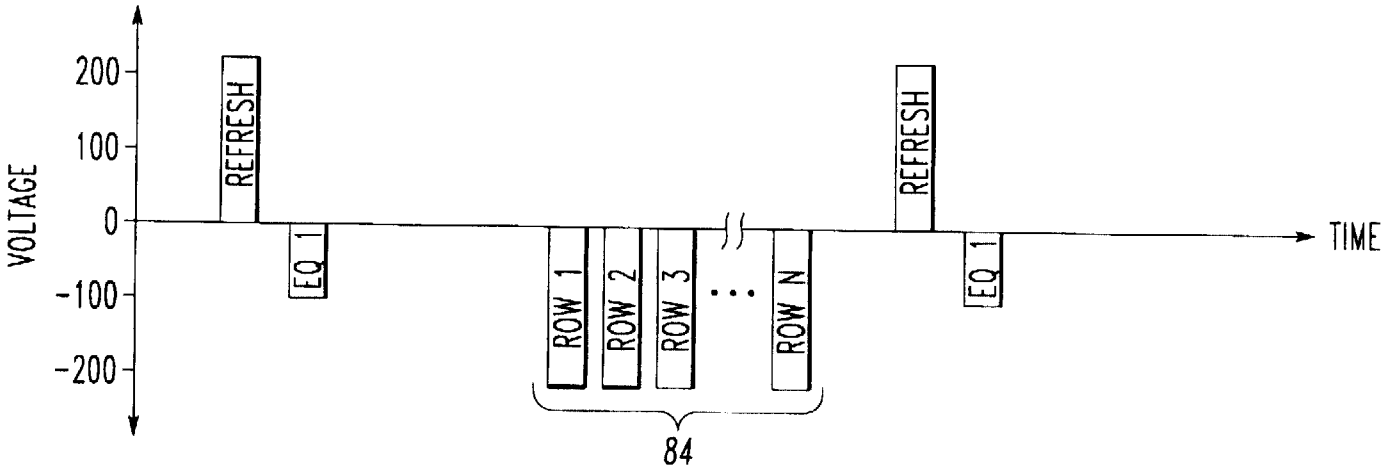
Figure 12:
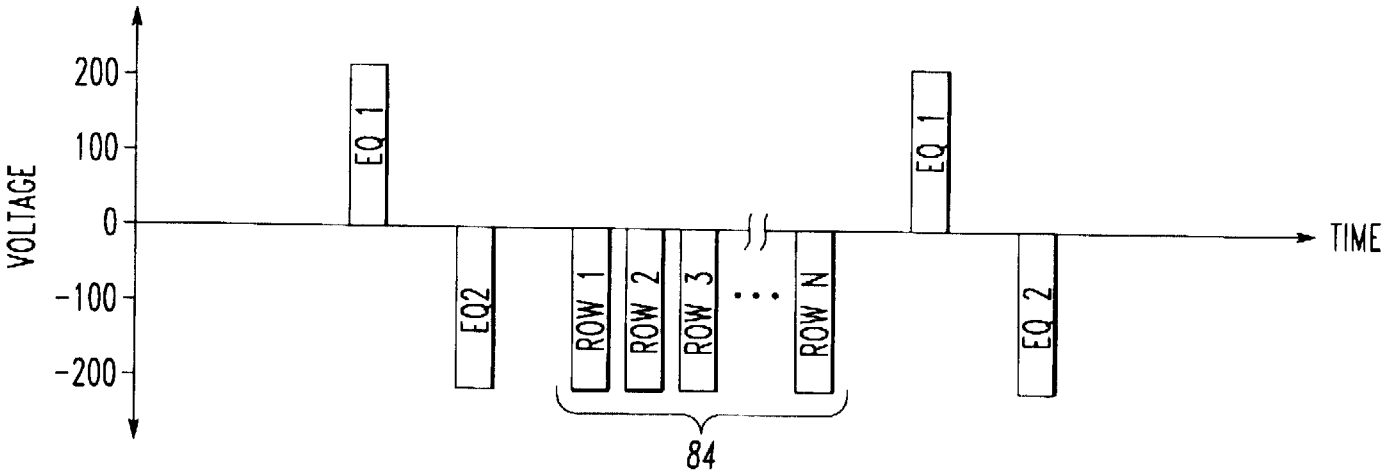
Figure 13:
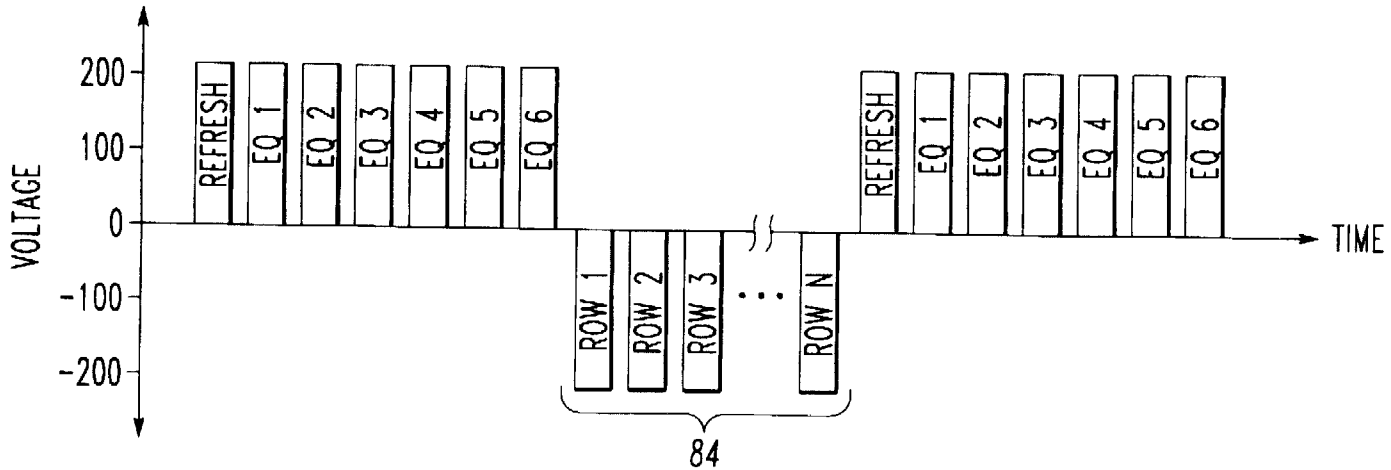
Figure 14:
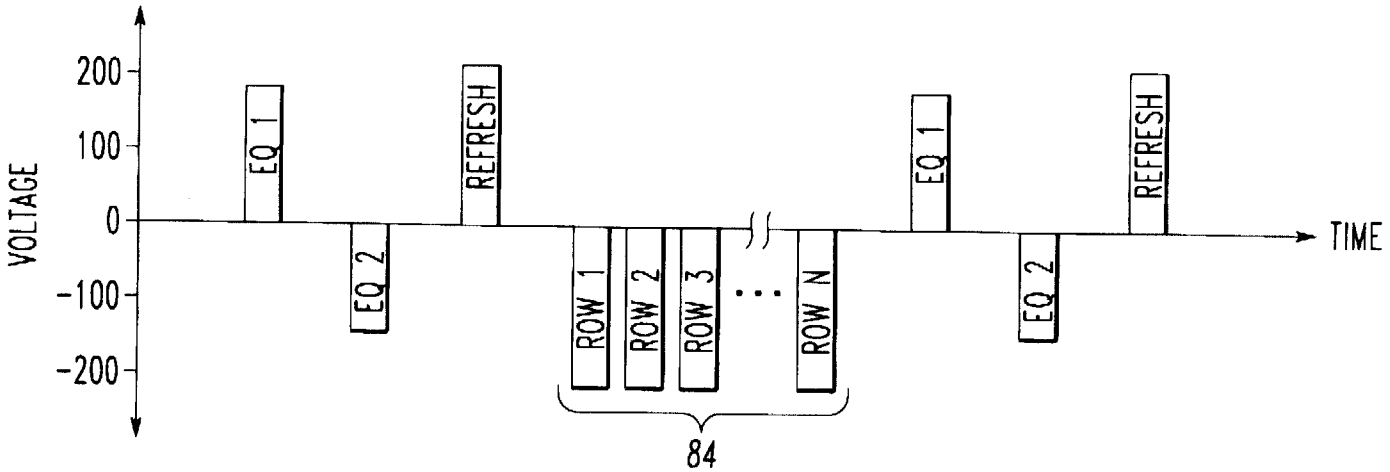

A percent reduction in pseudo persistence was empirically determined in laboratory tests in the following way. Various pulse equalizing schemes (FIGS. 7–14) were applied to the panel under test and the time response of the light output for ten cycles after the write pulse returned to the threshold level value was recorded with a Pritchard model 1980A-WB photometer. Since the human eye responds to the average light output which is proportional to the integral of the luminance versus time, a digitizing oscilloscope was used to evaluate this integral by monitoring the real time output of the photometer focused on the panel under test. The same TFEL panel was also evaluated in the same manner with a conventional asymmetric drive scheme applied (e.g., FIG. 3A) and this result was used as a baseline for all comparisons. The percent reduction in pseudo persistence from this baseline was then calculated for each sequence. The results for each sequence associated with FIGS. 7–14 were as follows:

| SEQUENCE OF EQUALIZING PULSES | % REDUCTION IN PSEUDO PERSISTENCE |
|---|---|
| FIG. 7 | 20% |
| FIG. 8 | 23% |
| FIG. 9 | 24% |
| FIG. 10 | 24% |
| FIG. 11 | 27% |
| FIG. 12 | 27% |
| FIG. 13 | 28.5% |
| FIG. 14 | 29% |

It should be understood that the scope of the present invention is not limited to the specific pulse sequences shown herein. That is, although specific drive sequences having certain number of pulses and voltage values are disclosed herein, these numbers are used only by way of example to facilitate an understanding of the invention, and not by way of limitation on the invention. As one skilled in the art will understand, the specific number of pulses and voltage values required for the equalizing pulses will depend on the characteristics and requirements of each type of panel.

In addition the present invention is applicable to both symmetric and asymmetric drive schemes, and panels with without gray scale capability. Furthermore, while it is obvious, it is still worth stating that the present invention is clearly not limited to drive electronics shown in FIG. 2. It is contemplated that any TFEL panel seeking to reduce latent image and pseudo persistence problems can use the equalizing pulses of the present invention.

All the foregoing changes and variations are irrelevant of the invention, it suffices that a thin film electroluminescent display panel is driven with either a symmetric or asymmetric drive scheme which includes at least one equalizing voltage pulse per write cycle.

Although the present invention has been shown and described with respect to a preferred embodiment thereof, it should be understood by those skilled in the art that various other changes, omissions and additions may be made to the embodiments disclosed herein, without departing from the spirit and scope of the present invention.

We claim:

1. A symmetrical drive method of respectively applying write and modulation voltages across intersecting row and column electrodes of an AC thin film electroluminescent display panel forming thereby a frame of pixels to display information on the panel, comprising the steps of:

generating a continuous or discrete ramped voltage signal;

coupling said ramped voltage signal to a set of column drivers, said column drivers operating as sample-and-hold devices for sampling said ramped voltage signal at a predetermined time and retaining a sampled value thereof to provide a variable modulation voltage signal for said pixels during a frame generation period to vary the luminance of said pixels;

applying said variable modulation voltage to said column electrodes during each write cycle;

generating positive and negative supply voltage signals;

coupling said positive and negative supply voltage signals to a set of row drivers for generating positive and negative polarity write signals;

applying first write pulse voltage signals of one of said positive and negative polarities sequentially to all of said row electrodes in a first write cycle;

applying second write pulse voltage signals sequentially to all of said row electrodes of substantially the same magnitude as said first write pulse voltage signals but now of an opposite polarity from said one polarity in a second and alternate write cycle; and generating and simultaneously applying a first equalizing voltage pulse signal having a positive or negative voltage polarity and a second equalizing voltage pulse signal having an opposite voltage polarity from the polarity of the first equalizing voltage pulse signal to all of said row electrodes in said first and second write cycles to thereby remove electrons trapped at dielectric interfaces of said pixels, said equalizing voltage pulse signals having a pulse width about equal to or greater than the pulse width of said first and second write pulse voltage signals and also having a voltage magnitude of a predetermined value so as to reduce latent images and pseudo persistence.

2. A method in accordance with claim 1 wherein said first and said second equalizing voltage pulse signals are applied in succession.

3. A symmetrical drive method of respectively applying write and modulation voltages across intersecting row and column electrodes of an AC thin film electroluminescent display panel forming thereby a frame of pixels to display information on the panel, comprising the steps of:

generating a continuous or discrete ramped voltage signal;

coupling said ramped voltage signal to a set of column drivers, said column drivers operating as sample-and-hold devices for sampling said ramped voltage signal at a predetermined time and retaining a sampled value thereof to provide a variable modulation voltage signal for said pixels during a frame generation period to vary the luminance of said pixels;

applying said variable modulation voltage to said column electrodes during each write cycle;

generating positive and negative supply voltage signals;

coupling said positive and negative supply voltage signals to a set of row drivers for generating positive and negative polarity write signals;

applying first write pulse voltage signals of one of said positive and negative polarities sequentially to all of said row electrodes in a first write cycle;

applying second write pulse voltage signals sequentially to all of said row electrodes of substantially the same magnitude as said first write pulse voltage signals but now of an opposite polarity from said one polarity in a second and alternate write cycle; and generating and applying at least one equalizing voltage pulse signal having a positive or negative voltage polarity and at least one other equalizing voltage pulse signal having an opposite voltage polarity from the polarity of said at least one equalizing voltage pulse signal to all of said row electrodes simultaneously during each of the write cycles to thereby remove electrons trapped at dielectric interfaces of said pixels, said equalizing voltage pulse signals having a pulse width about equal to or greater than the pulse width of said first and second write pulse voltage signals and also having a voltage magnitude of a predetermined value so as to reduce latent images and pseudo persistence.

4. A method in accordance with claim 2 wherein a said one and a said one other equalizing voltage pulse signal are applied in succession.

5. A method in accordance with claim 3 wherein said at least one equalizing voltage pulse signal and said at least one other equalizing voltage pulse signal are applied at the end of said write cycles.

* * * * *